US008382646B2

(12) United States Patent
Schöenenberger

(10) Patent No.: US 8,382,646 B2
(45) Date of Patent: Feb. 26, 2013

(54) WALKING AID FOR A MECHANICALLY DRIVEN TREADMILL

(76) Inventor: Willi Schöenenberger, Wädenswil (CH)

( * ) Notice: Subject to any disclaimer, the term of this patent is extended or adjusted under 35 U.S.C. 154(b) by 410 days.

(21) Appl. No.: 11/886,891

(22) PCT Filed: Jan. 20, 2006

(86) PCT No.: PCT/EP2006/000523

§ 371 (c)(1),
(2), (4) Date: Dec. 16, 2008

(87) PCT Pub. No.: WO2006/108457

PCT Pub. Date: Oct. 19, 2006

(65) Prior Publication Data

US 2009/0215589 A1 Aug. 27, 2009

(30) Foreign Application Priority Data

Apr. 14, 2005 (DE) ..... 10 2005 017 330
Jul. 21, 2005 (DE) ..... 10 2005 034 197

(51) Int. Cl.
*A63B 22/02* (2006.01)

(52) U.S. Cl. ..... 482/54; 434/255

(58) Field of Classification Search ..... 482/51, 482/54, 69, 66, 92, 142; 434/255; 607/49; 602/16, 23, 26, 36; 601/23, 33, 35, 36; 73/379.01
See application file for complete search history.

(56) References Cited

U.S. PATENT DOCUMENTS

| | | | | |
|---|---|---|---|---|
| 219,439 | A * | 9/1879 | Blend | 601/23 |
| 658,464 | A * | 9/1900 | Reinli | 280/47.4 |
| 2,210,269 | A * | 8/1940 | Taylor | 601/33 |
| 2,476,617 | A * | 7/1949 | Mueller | 403/9 |
| 3,824,994 | A | 7/1974 | Soderberg, Sr. | |
| 4,925,183 | A * | 5/1990 | Kim | 482/61 |
| 5,451,194 | A | 9/1995 | Harrigan | |
| 6,663,539 | B1 | 12/2003 | Wu | 482/52 |
| 6,666,831 | B1 | 12/2003 | Edgerton et al. | |
| 6,821,233 | B1 * | 11/2004 | Colombo et al. | 482/54 |
| 2004/0063549 | A1 * | 4/2004 | Kuo | 482/54 |
| 2005/0273022 | A1 | 12/2005 | Diaz et al. | |
| 2006/0211957 | A1 | 9/2006 | Beny et al. | |
| 2008/0234113 | A1 * | 9/2008 | Einav | 482/66 |

FOREIGN PATENT DOCUMENTS

| | | | |
|---|---|---|---|
| DE | 200 19 732 UI | | 5/2001 |
| DE | 101 39 276 | A1 | 5/2002 |
| EP | 1120098 | A1 | 8/2001 |
| KR | 10-2002-008760 | B1 | 1/2002 |
| WO | 2006094018 | A1 | 9/2006 |

* cited by examiner

*Primary Examiner* — Stephen Crow
(74) *Attorney, Agent, or Firm* — Seed IP Law Group PLLC

(57) ABSTRACT

The invention relates to a walking aid for a mechanically driven treadmill, comprising at least one tractive element that is guided over two respective deflection rollers and that is driven directly or indirectly by means of the treadmill. The tract of said element that directly faces the treadmill belt is displaced in the same direction as said belt and the tract of the element that faces away from the belt is displaced in the opposite direction to the latter. The aid also comprises at least one fixing element, which is located on the tractive element, for supports for part of the feet and/or legs.

49 Claims, 7 Drawing Sheets

WALKING AID FOR A MECHANICALLY DRIVEN TREADMILL

BACKGROUND

1. Technical Field

The present invention relates to a walking aid for a mechanically driven treadmill.

2. Description of the Related Art

Treadmill training has been successfully used for some time in the treatment of paraplegic patients and/or patients suffering from neurological damage and illnesses. A suspension device provides partial body weight relief to enable the patient to train (e.g., to walk) even if the patient is unable to walk independently or can only walk with therapeutic assistance. Training can stimulate the metabolic processes and maintain the function of the muscles and joints.

Even if a partial body weight relief is achieved through the suspension device, most patients generally need their feet to be placed in position by the physiotherapist. Generally, up to three physiotherapists are needed, and the treatment is physically very demanding for them. The therapist may sit when positioning the patient. On the one hand, the sitting position for the therapist is unfavorable, and there is a high load on the spinal column, so that, with this activity, therapists often complain that they are suffering from problems in various areas of the spine.

In addition, one disadvantage of the patients' legs being moved by the therapists is that the patients' feet are often not properly positioned for training. This often leads to asymmetrical movement sequences.

Computer-aided methods of movement control have been developed and implemented in exercise robots in order to move the patients' lower extremities. Because this type of system is very expensive, its use is only possible to a limited extent.

DE 101 39 276 describes a walking training system having a treadmill. The walking training system has two wheels that are independent of each other and driven by the treadmill. Each wheel is provided with devices to hold a lower leg in place. An individually adjustable walking movement is transmitted to the lower extremities of the user via a sliding mechanism inserted in a longitudinal hub. The fixing device is attached to the sliding mechanism. Because the sliding mechanism can be moved within the longitudinal hub, there is a considerable risk of injury when positioning the individual lower legs, if the sliding mechanism is not in the proper position. In addition, the two wheels must be arranged exactly in relation to each other in order to ensure even movement. The walking training system has a complicated construction and is therefore expensive to manufacture and to maintain.

BRIEF SUMMARY

Some embodiments of the present invention provide a simple walking aid which produces a movement similar to natural walking. In addition, the walking aid can reduce the burden on the therapists and allows the patients to train independently on their own.

In some embodiments, a walking aid for a mechanically driven treadmill comprises at least one tractive element that is guided over two deflection rollers in each case and that is driven directly or indirectly by means of the treadmill. A section of the tractive element directly facing the treadmill belt moves in the same direction as the treadmill belt and a section of the tractive element facing away from the treadmill belt moves in the opposite direction of the treadmill belt. The walking aid also comprises at least one fixing element arranged on the tractive element for holding devices for the foot and/or leg area.

The walking aid according to some embodiments has a very simple structure. On the one hand, specific positions of the two lower legs or feet may be desired. Because the movement is achieved through a tractive element, a very even movement can be ensured. Achieving an almost natural sequence of movements is possible without needing to make any additional settings. The walking aid according to some embodiments gives the patient a desired amount of independence, since the aid of a therapist is only required to step onto the treadmill and to fix the lower legs. The therapist's work is made easier such that the therapist can care for additional patients. Because the walking aid is moved via the treadmill, an additional drive system is not necessary.

Automatic treadmill therapy can be used as an effective standard therapy for many motor diseases, injuries, and orthopaedically/traumatologically ill patients. For example, the automatic treadmill therapy can be used to treat hemi-tetraplegics, para-tetraplegics, spastic paralysis, multiple sclerosis, and cranio-cerebral trauma.

In addition, automated treadmill therapy can also be used in geriatrics to maintain the mobility of elderly people. Advantageously, the therapy, in some embodiments, can be carried out independently without any therapeutic assistance so that the treated people can retain their independence for as long as possible.

According to some embodiments, the walking aid can include two deflection rollers and one tractive element. This construction limits the components to a minimum. In addition, the movement of both lower legs is achieved via a single system by means of a single tractive element, thereby providing a very even movement.

In some embodiments, two fixing elements can be arranged at diametrically opposed positions on the tractive element. In this way, the position of the two lower legs in relation to each other is maintained so that an almost natural sequence of movements can be achieved directly without any additional settings.

In some embodiments, the fixing elements can have lower leg holding devices. Each of the lower leg holding devices is swivellable about an axle that is parallel to the deflection roller axle. This arrangement ensures that the movement produced by the walking aid generally corresponds to a natural movement. It also results in the vertical axle of the holding device constantly changing because of the bending of the knee and the path of travel of the tractive element.

According to another embodiment, the walking aid can have four deflection rollers and two tractive elements. Each tractive element engages two deflection rollers. The tractive elements are arranged parallel to each other. This provides a separate movement element for each foot or leg, the position of which can be changed independently of each other, in order to carry out other movement rhythms without any major alteration work.

The fixing elements extend into the space between the parallel tractive elements. The user stands between the two walking aids formed by the deflection rollers and tractive elements so that there is sufficient space to perform the desired movement. This may reduce the risk of injuries from contact with the walking aid. Both fixing elements can be arranged on the tractive element in accordance with the desired position of each leg.

The tractive element can be a chain and the deflection rollers can be formed as chain wheels. The chain wheels and chains provide a very simple way of producing the intended movement. The chain and chain wheel system may be easy to maintain and has been tried and tested for a long time.

In some embodiments, the tractive elements can be toothed belts. The toothed belt can rest directly on the treadmill in order to transfer the movement of the treadmill to the deflection rollers. Furthermore, the external surface of the toothed belt can be provided with an additional material (e.g., material affixed to the belt) which increases contact with the treadmill surface. The additional material can be, for example, a rubber strip which is applied to the toothed belt and vulcanized. The material can be interrupted so that no pulling forces arise on deflection. With this embodiment, the fixing element can be arranged on the top side of the toothed belt. Here, the deflection rollers can be coupled to a central frame. The deflection rollers can be arranged to the left and right of the patient during use. This reduces the width of the device, so that the patient's legs are not spread too far apart.

According to some embodiments, a drive wheel in contact with the treadmill can be assigned to at least one deflection roller. A drive wheel of this type can start the movement of the deflection rollers in a simple manner, so that the movement of the treadmill is easily transmitted to the tractive elements.

Advantageously, the drive wheels can be formed concentrically with respect to the deflection rollers. The diameters of the drive wheels can be substantially equal to the diameters of the deflection rollers. The drive wheels in contact with the deflection rollers have a common axle, so that the actual speed of movement of the walking aid can be determined by the diameters.

According to another embodiment, it can be provided that the movement of the treadmill is transferable from a drive wheel, in frictional contact with the treadmill, to a drive wheel arranged at a distance to that drive wheel and assigned to the deflection roller. Here, the treadmill movement is not transferred directly to the walking aid. Instead, the treadmill movement is transferred via a separate movement sequence that is independent of the deflection rollers. In this way, a very even movement sequence similar to a natural movement is achieved. In addition, such a walking aid is very easy to construct, install, maintain and repair, since the drive and the movement achieved via the deflection rollers are separated from each other.

According to a further embodiment, the drive wheel in frictional contact with the treadmill can be positioned at approximately right angles to the deflection roller. In this way, the distance between the two drive wheels is kept to a minimum so that long transmission paths are avoided.

Additionally, the drive wheel can be assigned to the rear deflection roller. In this way, the walking aid is stabilized on the treadmill and an even transmission of the movement is ensured. Similarly, the drive wheel can be assigned to the front deflection roller. In this way, the drive wheel can be moved away from the walking aid to, for example, exclude any contact with the patient. Furthermore, the adhesion between the treadmill and the drive wheel can be increased, because of leverage from the backwards walking aid produces a higher drive pressure between the drive wheel and the treadmill.

According to a further embodiment, the drive wheel in frictional contact with the treadmill can be arranged in front of the deflection roller. Because the drive wheel is arranged in front of the actual walking aid, the walking aid can be arranged very close to the treadmill. This may effect the lower tractive element tract facing the treadmill.

Advantageously, both drive wheels can be friction wheels. Another wheel can be positioned between the two drive wheels. The additional wheel can contact the drive wheels. The transmission of the treadmill motion via friction wheels is a very simple method of transmission; here, the additional wheel can be used to ensure that the deflection rollers are moving in the same direction as the lower drive wheel.

According to a further embodiment, the drive wheels in contact with the treadmill can be connected to each other via a tractive element. Various types of known transmission means, which are frequently and successfully used in practice, allow for fast, simple maintenance.

According to another embodiment, a guide for the holding device that is independent of the tractive element can be provided. A guide of this type ensures that the movement carried out by the holding devices is very even and exact.

According to a further embodiment, the fixing element can be a catch that is arranged on the tractive element such that the fixing element is fixed and cannot be rotated. Because of the catch, the holding device can be transported at a greater speed. The impetus phase, as it is called, of the leg to be transported forward may reach a higher speed.

Advantageously, the catch can be arranged on the side of the tractive element facing away from the deflection rollers. The catch can extend a predetermined distance from the tractive element and be formed in the longitudinal direction with a receiver slot, in which a leg brace support is arranged so that it can be moved along the receiver slot. A catch of this type has proved successful in practice. The receiver slot acts as a guide. Accordingly, the guide ensures that desired predetermined movements are achieved.

According to another embodiment, the walking aid can be arranged in a housing which is formed with a guide element arranged at a predetermined distance around the deflection rollers, through which the leg brace support, from the catch, can extend out of the housing. This provides a guide element in a very simple manner without additional means being necessary, since the guide element is formed inside the housing.

Advantageously, the guide element can be formed as a slot-shaped opening.

According to a further embodiment, at least the section of the slot-shaped opening facing the treadmill is substantially parallel to the treadmill, and the slot-shaped opening can extend around each of the deflection rollers at a predetermined distance. The distance and the parallel distance can be elected to produce the most even movement possible, which comes close to natural movement. Different movement patterns can be achieved through the choice of the slot shape and the position of the slot.

Advantageously, the slot-shaped opening around the deflection rollers is formed as a section of a circle. Here, it can be provided that the sections of the circle have different diameters. It has been proved advantageous if, in operation, the larger diameter is at the rear deflection roller. These embodiments contribute, once again, to the evenness of the movement pattern and to the achievement of different movement patterns.

According to a further embodiment, the housing can consist of two parallel plates. This provides sufficient protection for the user in order to reduce the likelihood of injuries from the moving parts of the walking aid.

Advantageously, the deflection rollers and the drive wheels can be arranged between and fixed to the two plates. This in turn simplifies the structure, since no complicated additional holding device needs to be provided.

According to another embodiment, a running wheel can be arranged on the housing at a predetermined distance to the front deflection roller in contact with the treadmill. This stabilizes the walking aid further, so that two support points are provided.

Advantageously, the support of the leg brace can be fixed so that it swivels at the leg brace receiver. This feature ensures that the lower leg is kept in the desired movement position.

Advantageously, a protective element can be arranged on each side of the tractive element facing away from the fixing element. This protects at least one side of the walking aid so that there is no adverse effect on the movement sequence.

According to a further embodiment, it can be provided that the drive wheels mesh with the deflection roller arranged on the outside of the protective element. Consequently, the individual transmissions of movements are clearly separated from each other, which again may help simplify maintenance and repair.

Advantageously, the walking aid can be fixable to the frame of the treadmill. This ensures a stable arrangement of the walking aid on the treadmill. For example, the walking aid can be coupled to the handrail support.

According to a further embodiment, it can be provided that the two deflection rollers are connected to each other via a longitudinal beam and can be fixed via the longitudinal beam to the treadmill. This represents a very simple method of fixing the walking aid. Using the longitudinal beam, the two deflection rollers are fixed relative to each other, thus providing additional safety.

Advantageously, a sliding sleeve can be provided in the area of the longitudinal beam so that the walking aid can be moved relative to the handle. In this way, the walking aid can be conveniently set to the height of the patient to ensure that the handle is held securely by the patient during operation of the walking aid.

According to a further embodiment, the walking aid can be fixable to a handrail frame of the treadmill. This ensures further stabilization of the walking aid on the treadmill.

It is possible to arrange the walking aid in a fixed position and only to push it on the treadmill for use. The housing can extend to a cross beam arranged between the handrail frame and is movable around the cross beam. In this way, the walking aid can be folded and stored away if it does not need to be used. The treadmill can then be used for other therapeutic purposes.

Advantageously, the housing can be formed with a through hole to receive the cross beam. In this case, the housing does not need to be formed with additional fixings, so that the number of necessary parts is once again reduced.

Advantageously, it can be provided that the walking aid is connected via the protective element to the fixed side areas of the treadmill. This specifies the position of the walking aid on the treadmill.

Advantageously, the axle projecting through the protective elements to fix the front end of the walking aid can be the axle for the drive wheels in frictional contact with the treadmill. Once again, this simplifies the structure of the walking aid.

Advantageously, the axle can extend through the drive wheels of both tractive elements. The drive wheels are connected to each other through a swivellable axle, which means that the synchronism of the tractive element with the leg brace receiver on the left and right, diametrically, is achieved.

According to a further embodiment, the tractive element(s) can be arranged in a housing and the fixing elements can extend through slot-shaped openings formed in the outer plates of the housing. The fixing elements are held via guide elements in the slot-shaped opening. In this way, an additional stabilization of the fixing elements inside the slot-shaped opening is achieved. This has proved advantageous if pressure is exercised on the fixing elements, for example. At the same time, the play of the fixing elements within the slot-shaped opening is minimized.

Advantageously, each guide element can extend through the slot-shaped opening and comprise flat elements that are substantially parallel to the inside and outside walls of the external plates. Guide elements are very easy to manufacture and offer sufficient stability during use.

Each fixing element can be assigned two guide elements, which extend, in each case, through one of the parallel plates. In this case, one guide element is formed on the fixing element, whereas the second one extends, on the side facing away from the fixing element, into the opposite slot. In this way, the fixing element is securely held and, at the same time, any unilateral pressure exerted on the tractive element is minimized.

Advantageously, two tractive elements can be formed in the housing. An inner guide with a slot-shaped opening can be arranged between the tractive elements. The guide arranged on the side of the tractive element facing away from the fixing element can reach into the slot-shaped opening of the inner guide. Here too, stabilization is provided on both sides of the tractive element. Stabilization on the side of the tractive element facing away from the fixing element is, however, provided in the inside of the housing and is thus not visible. This means that any risk of injury by the second guide element can be reduced or eliminated.

Advantageously, two inner guides can be parallel with each other.

In addition, it can be provided that the leg brace is formed with an automatically locking closure. This embodiment helps the user to remain independent of any therapist, since the leg brace can be clicked automatically into place and can be unlocked without any manual intervention.

DETAILED DESCRIPTION

Figure 1:
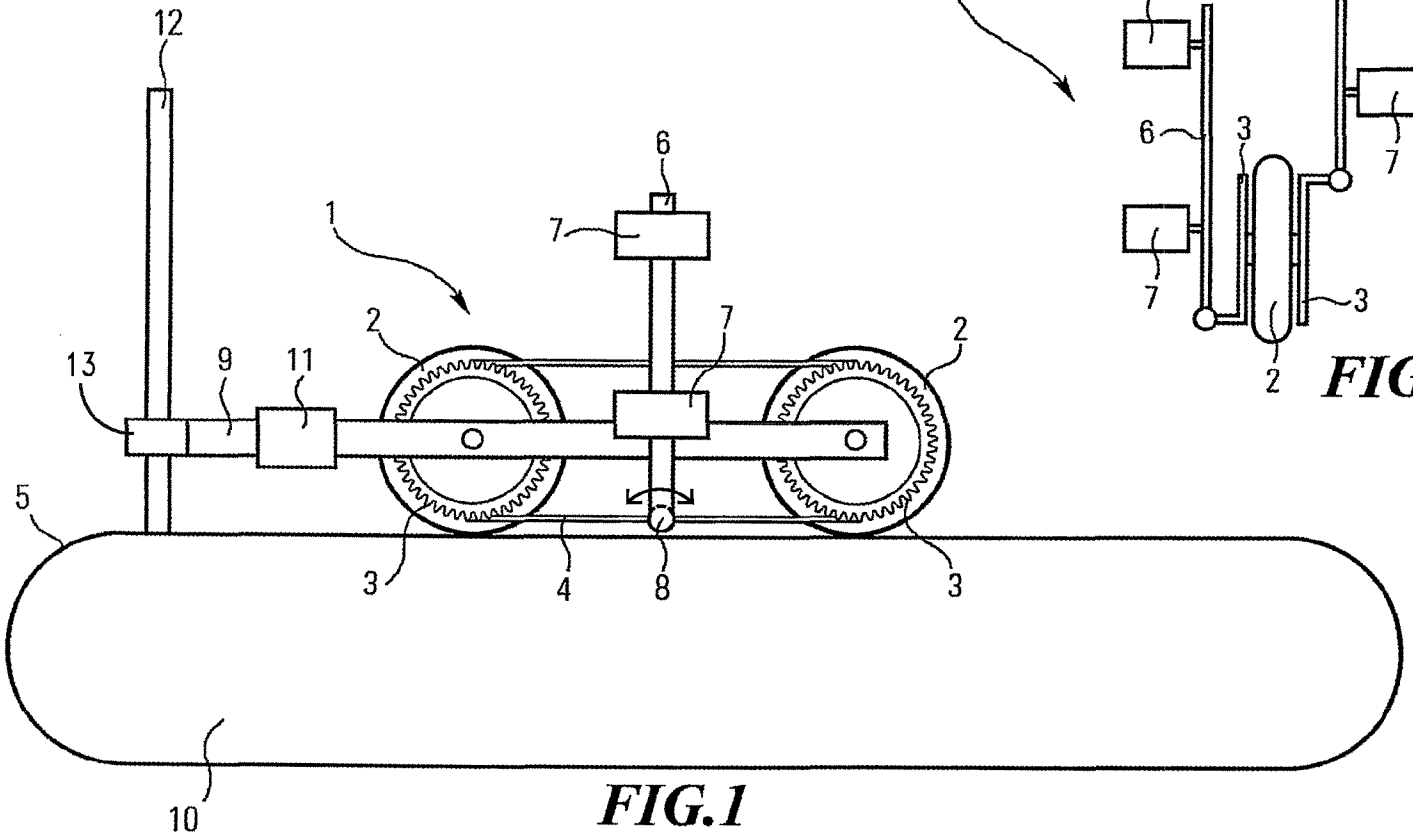
FIG. 1 is a side view of a walking aid placed on a treadmill, according to one illustrated embodiment.

The walking aid 1 shown in FIG. 1 comprises two drive wheels 2 arranged next to each other at a predetermined distance. Here, the drive wheels 2 can be coated with rubber in order to ensure the quietest possible movement on the treadmill.

Figure 2:
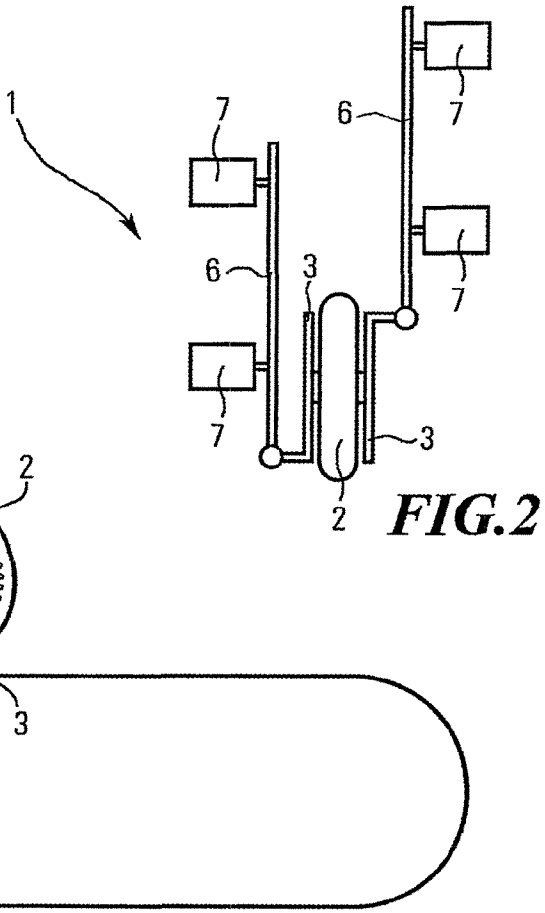
FIG. 2 is a front view of the walking aid shown in FIG. 1.

Each drive wheel 2 is assigned a chain wheel 3. The drive wheels 2 and respective chain wheels 3 are connected in such a way that the movement of the drive wheel 2 is transmitted to the chain wheel 3. As shown in FIG. 2, the drive wheel 2 and the chain wheel 3 are almost the same size and connected to each other via a common axle.

The two chain wheels 3 are connected to each other via a chain 4 and act as deflection rollers. The chain 4 runs between the chain wheels 3 and can be substantially parallel to the walking surface of the treadmill 10.

If the treadmill 10 is set in motion, the drive wheels 2 start to move at the same time. The movement of the drive wheels 2 is transmitted to the chain wheels 3. The chain wheels 3 drive the chain 4. The section of the chain 4 facing the treadmill is moved in the same direction as the walking surface of the treadmill and a section of the chain 4 facing away from the walking surface of the treadmill in the opposite direction of the walking surface of the treadmill. In the illustrated embodiment, the section of the chain 4 facing away from the treadmill 10 may deflect downwardly (e.g., sag).

As shown in FIG. 2, a holding device for a lower leg in each case is arranged at two opposing positions of the chain (not shown in FIG. 2). The positions can be diametrically opposite to each other. The holding device can be at the bottom for the leg to be moved backwards, and another holding device can be at the top for the leg to be moved forward.

Each lower leg holding device comprises a leg brace device 6 with a leg cuff 7, which is connected to the chain 4. Here, the point of fixation of the leg brace device 6 is formed at the chain 4 as swivel point 8, so that the leg brace device can be swivelled around the movable swivel point 8. In this way, an almost natural movement sequence is achieved when the chain 4 is moved. In this respect, the swivel point 8 can also be formed at a predetermined distance from the chain in order to, for example, prevent any possible risk of injury by the chain.

In operation, the legs of the patient are fixed via respective leg cuffs 7 to the leg brace devices 6. When the treadmill 10 is set in motion, the patient's lower legs fixed in the leg brace devices 6 are moved via the movements transmitted from the drive wheels 2 to the chain wheels 3 and thus to the chain 4. Here, the leg on the walking surface, i.e., the leg moved by the lower section of the chain, is moved backwards. That section of the chain is moved around the rear chain wheel 3 and then travels towards the front chain wheel 3 (i.e., in the opposite direction to the direction of the track of the treadmill 10). The other leg moved by the section of the chain facing away from the treadmill 10 is moved via the front chain wheel 3 downwards towards the walking surface of the treadmill and then moved backwards. This achieves an even walking movement, the speed of which can be regulated via the speed of the treadmill walking surface.

To fix the walking aid 1 on the treadmill 10, the two drive wheels 2 of the walking aid are connected to each other via a longitudinal beam 9 which projects beyond the front drive wheel 3 and has a fixing device 11 at its front end. Using this fixing device 11, the walking aid 1 can be fixed to the handrail support 12 of the treadmill 10. In this way, the walking aid 1 can be fixed at the distance from the handle that suits the patient.

In addition, in the section of the longitudinal beam 9 between the handrail support 12 and the front drive wheel 3, a sliding sleeve 13 is configured to allow the position of the walking aid 1 to be changed in relation to the handrail support 12 and thus to the handle, so that the walking aid can be set to suit the height of the patient. The sliding sleeve 13 also has the function of arranging the walking aid 1 on the treadmill after the patient is in a vertical position on the treadmill. A patient can be conveniently taken to the treadmill in a wheelchair and brought into a vertical position using a load relief system, especially if the walking aid arranged on the treadmill would be a disturbance in the patient's preparatory phase.

Figure 3:
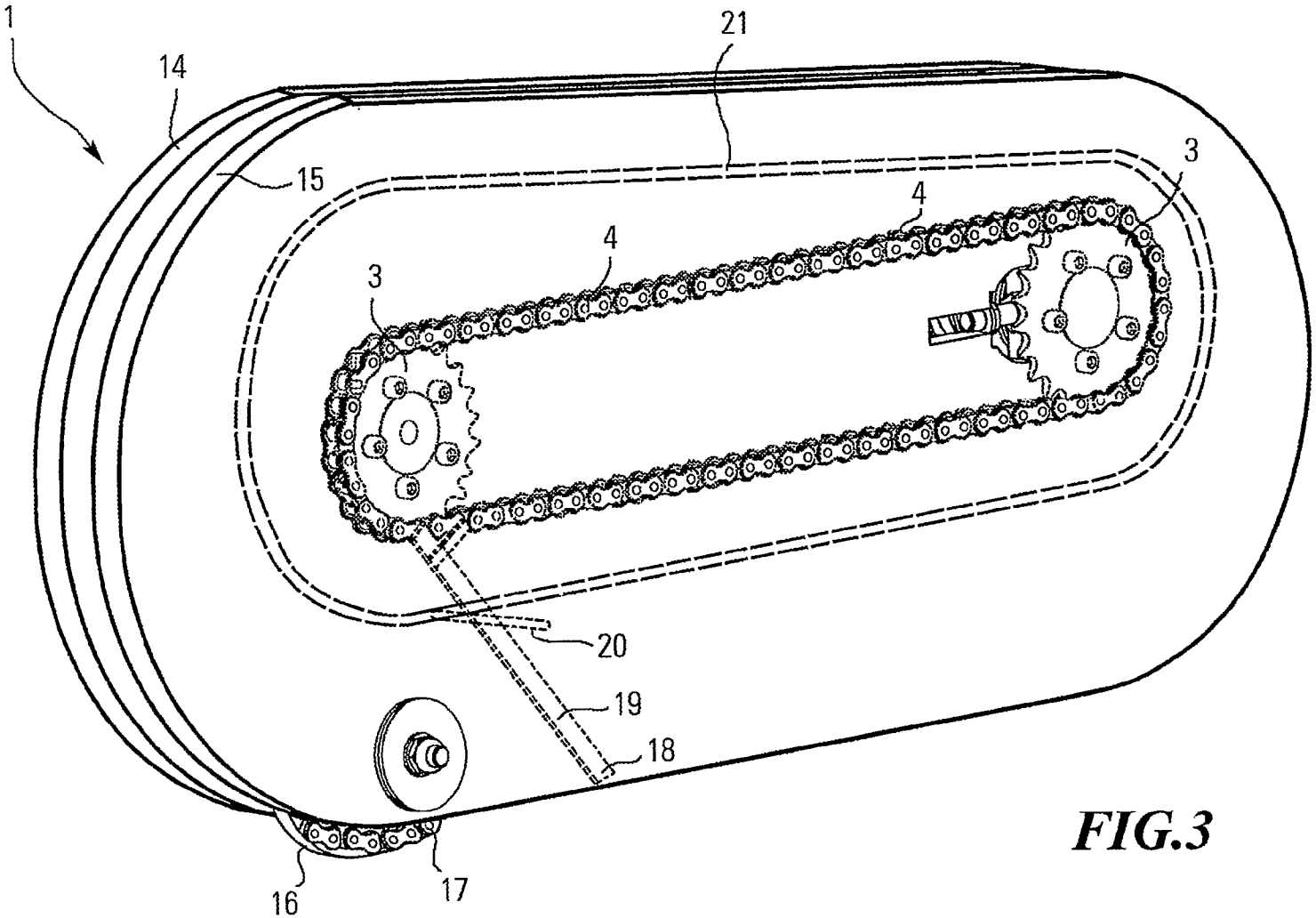
FIG. 3 is a partial sectional view of a walking aid, according to one illustrated embodiment

Another embodiment of the walking aid is shown in FIG. 3. Similar elements of the walking aid are designated with the same reference symbols in FIGS. 1 and 2.

The walking aid 1 shown in FIG. 3 comprises two adjacent deflection rollers 3 arranged at a predetermined distance to each other. In this respect, the two deflection rollers 3 are chain wheels and are connected to each other via a chain 4. The two deflection rollers 3 are arranged inside a housing. The housing includes two plates 14, 15. Although not shown, in operation the plates 14, 15 are connected to each other via a connecting element, at least in the areas facing away from the treadmill 10, thus closing the housing.

A drive wheel 16 is assigned to one of the two deflection rollers 3 and is arranged roughly vertically underneath the deflection rollers 3, near to the areas of plates 14, 15 facing the treadmill. The drive wheel 16 is formed in such a way that the running surface of the drive wheel projects beyond the housing. The running surface can be coated with rubber in order to ensure the quietest possible movement on the treadmill.

In operation, the drive wheel 16 directly rests on the treadmill 10 and is set in motion through the movement of the treadmill. Furthermore, the drive wheel 16 has on one side a toothed wheel and is connected via this toothed wheel and a chain 17 arranged on this to a second drive wheel, which is not shown. This second drive wheel can be parallel to the drive wheel 16 and coupled to an axle with the deflection roller 3 and has approximately the same diameter as the deflection roller 3. The movement transmitted from the drive wheel 16 via the chain 17 to the second drive wheel is directly to the deflection roller 3. In this way, the chain 4 extending between the deflection rollers 3 is also set in motion. The second drive wheel can also be formed as a component with the deflection roller 3. At two positions on the chain 4 opposite each other, a catch 18 is fixed in each case which is coupled directly to individual chain links via bolts so that it cannot be moved or swivelled. The connection can be made using rivets, for example. Here, the catch 18 is formed as a longitudinal element, which has a receiver slot 19 formed in a longitudinal direction. The catch 18 extends in the direction of the chain 4 facing away from the deflection rollers 3 and can preferably have an angle element near the chain, for stabilization, in order to be arranged stably at two points of the chain.

A leg brace receiver 20 is inserted into the receiver slot 19 of the catch 18 and can be moved along the receiver slot.

Each of the housing plates 14, 15 can be formed with a guide in the form of a slot-shaped opening 21. In this respect, this slot-shaped opening 21 at a predetermined distance around the chain 4. The precise positioning of the slot-shaped opening 21 can vary. In some embodiments, the area of the slot-shaped opening 21 facing the treadmill can be arranged substantially parallel to the treadmill. In the area of the deflection rollers 3, the slot-shaped opening 21 is formed mostly as a segment of a circle, whereby the individual circle segments opposite each other can have different diameters. If the circle segments have different diameters, the circle segment near the rear deflection roller 3 can be larger than the other circle segment. In this case, the substantially straight section facing away from the treadmill 10 extends downwards at an angle.

The shape and configuration of the slot-shaped opening 21 can be selected based on the required movement pattern. The leg brace receiver 20 extends through the receiver slot 19 of the catch 18 into the opening 21 and is preferably formed larger on the inside of the housing plate 14, 15 or is held by a fixing element on the inside of the housing plate 14, 15 to prevent the leg brace receiver 20 from slipping out of the slot-shaped opening 21.

If the treadmill is set in motion, the drive wheel 16 starts to move. The movement of the drive wheel 16 is transmitted via the chain 17 to the second drive wheel and thus to the deflection rollers 3 and the chain 4. The moving chain 4 carries the catch 18 and defines a fixed movement around the chain 4. The leg brace receiver 20 arranged inside the receiver slot 19 of the catch 18 is simultaneously moved by the catch 18 and thereby describes the movement determined by the slot-shaped opening 21. Because the leg brace receiver 20 is inside the receiver slot 19, the leg brace receiver can be moved in the longitudinal direction based on the position of the housing opening 21.

In operation, the leg brace is fixed in such a way at one end of the leg brace receiver 20 (e.g., at the end of the leg brace receiver 20 facing away from the housing) such that the leg brace can be swivelled around the leg brace receiver 20 in order to ensure that the lower leg of the user is always in a position corresponding to the desired movement.

Figure 4:
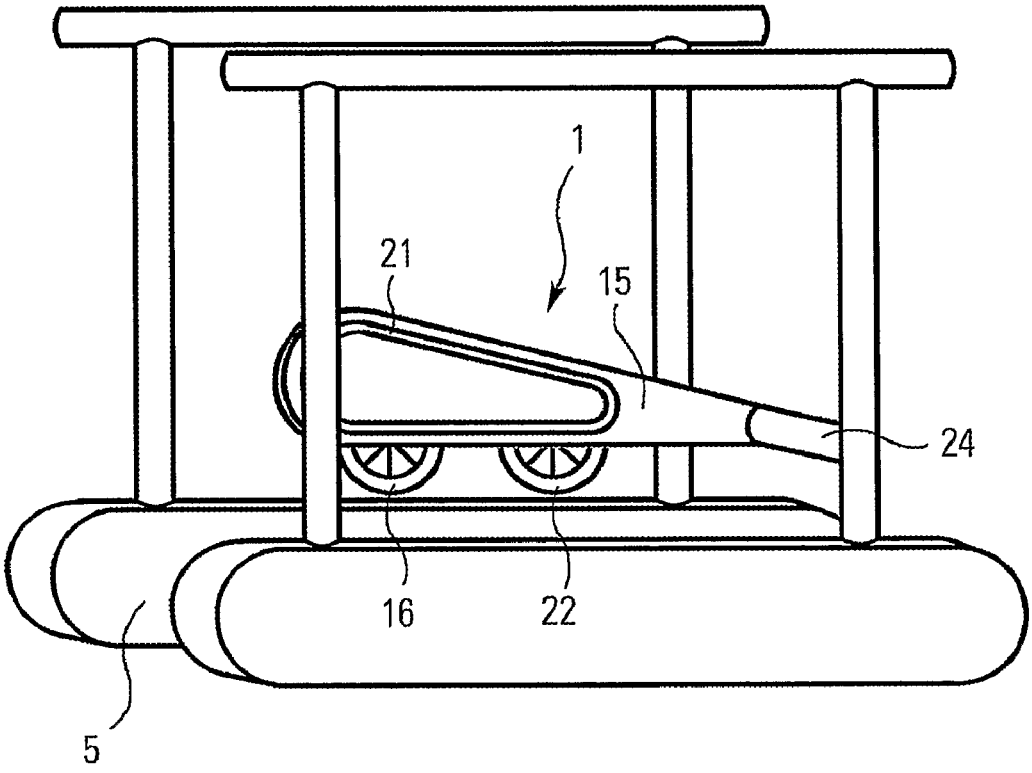
FIG. 4 illustrates the walking aid in FIG. 3, wherein the walking aid is arranged on a treadmill for the start of operation.
Figure 5:
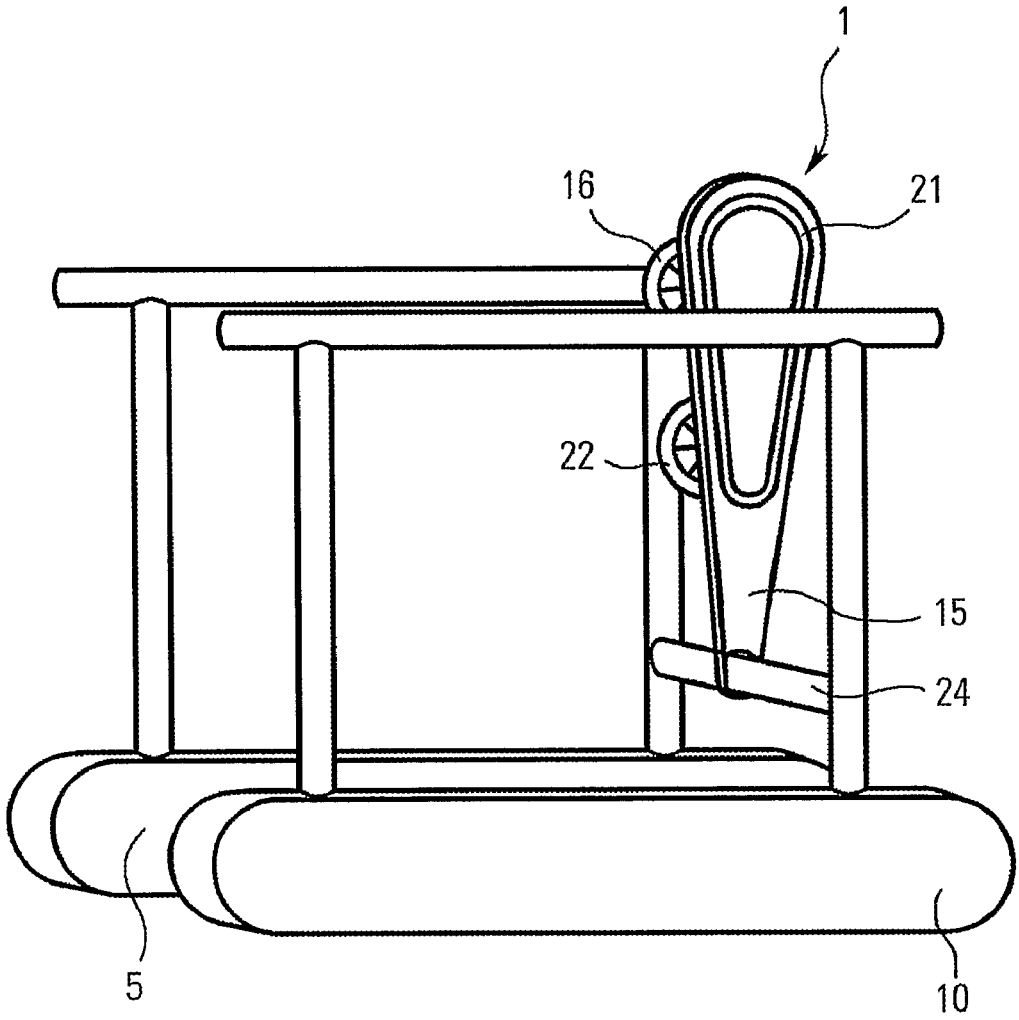
FIG. 5 illustrates the walking aid in FIGS. 3 and 4 in a folded back state.

FIGS. 4 and 5 show the walking aid illustrated in FIG. 3 mounted on the treadmill. With the embodiment shown, an additional wheel 22 is between the two plates 14, 15 of the housing. The wheel 22 only has a stabilizing function for the walking aid and is not connected to the deflection rollers 3 or the chain 4. Because the drive wheel 16 is located at the rear end of the walking aid, the additional wheel 22 is arranged near the front deflection roller, for example, between the front deflection roller 3 and the rear drive wheel 13 and also rests on the treadmill 10.

For positioning the walking aid 1 on the treadmill 10, the plates 14, 15 of the housing project at their front end beyond the front deflection roller and are connected at their front end to a holding device fixed to the handrail frame 23 of the treadmill 10, and in particular to the cross beam 24. The cross beam 24 extends through openings provided in the plates 14, 15.

As shown in FIG. 5, the walking aid can fold upwardly so that the treadmill 10 can also be used for other applications.

Figure 6:
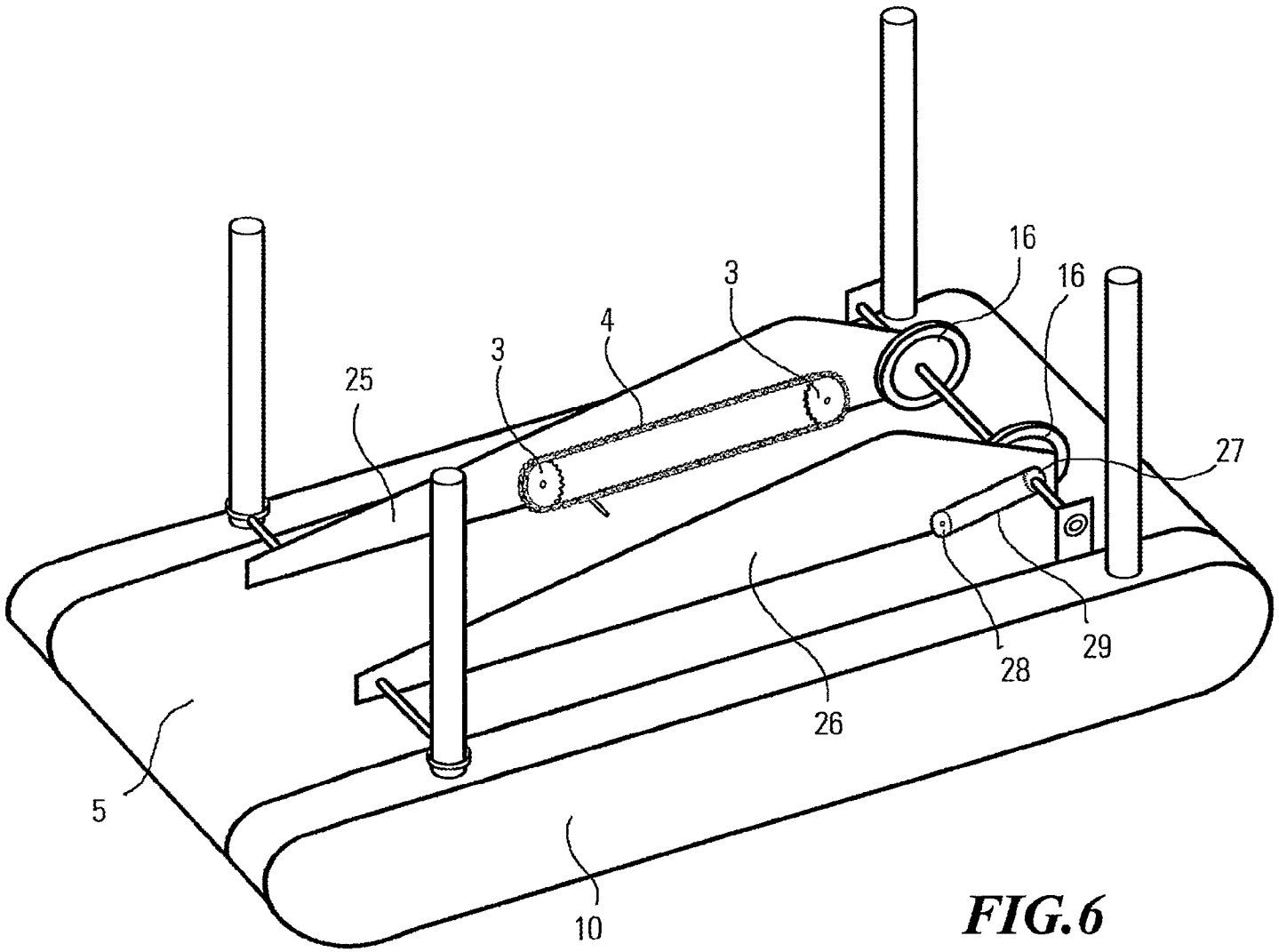
FIG. 6 is an isometric view of a walking aid, according to one illustrated embodiment.
Figure 7:
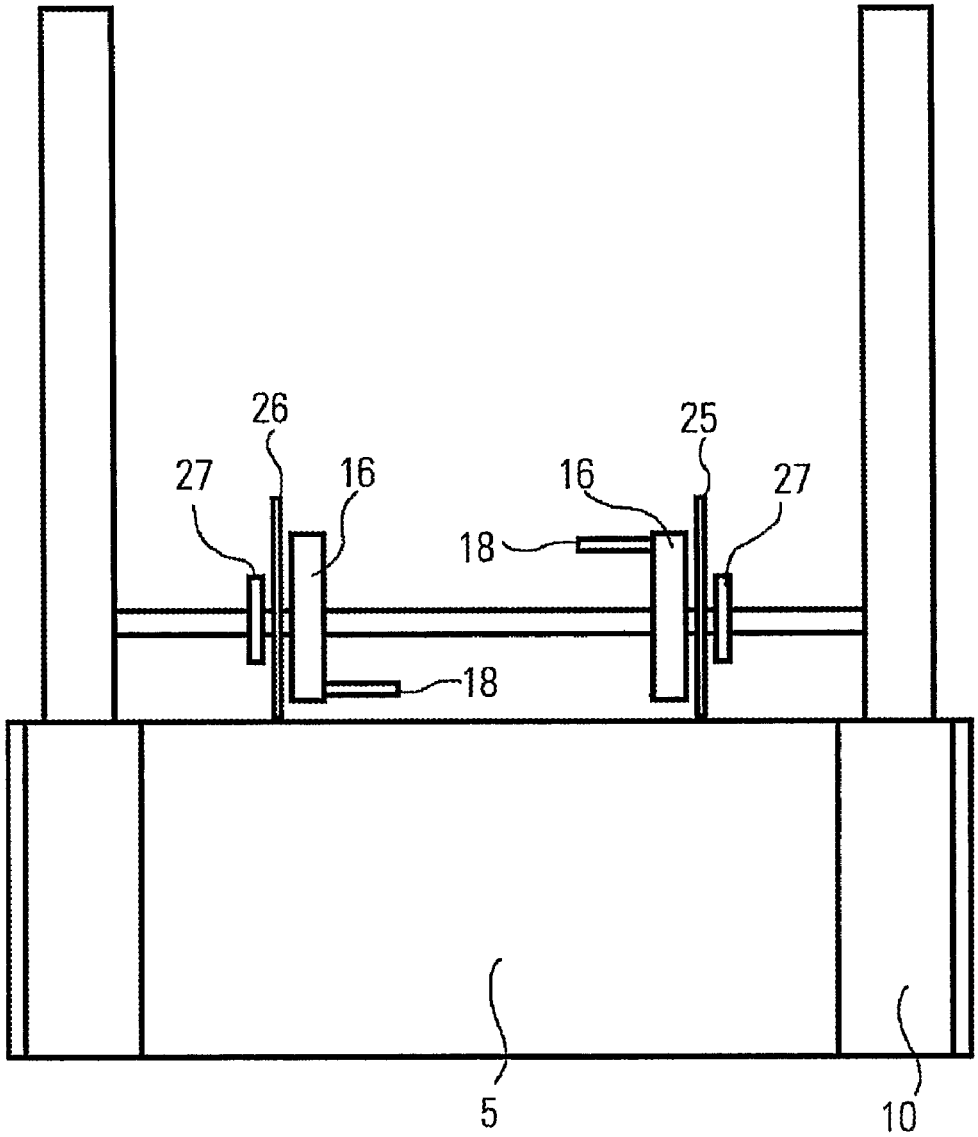
FIG. 7 is a front view of the walking aid in FIG. 6.

FIGS. 6 and 7 show yet another embodiment of a walking aid according to one illustrated embodiment.

The walking aid 1 includes four deflection rollers 3. Two chains 4 connect respective pairs of deflection rollers 3. Each pair of connected deflection rollers 3 is arranged in parallel opposite each other, and each chain 4 is provided with a catch 18 for a leg brace support. The two catches 18 are arranged on sides of the chains 4 facing each other. Here too, the catches 18, as shown in FIG. 7, are arranged at positions diametrically opposed to each other.

In contrast to the embodiments shown in FIGS. 1 and 3, each foot of the patient is fixed to a catch 18 that can be moved through a separate movement sequence. Each catch 18 can be set separately. In this way, various types of movement sequences can be simulated by the walking aid. The arrangement of the axles of the drive wheels, however, can ensure synchronism of the tractive element.

The deflection rollers 3 are fixed to the inside of plate-shaped protective elements 25, 26 so that a sufficient stabilization of the deflection rollers is achieved. At the same time, the walking aid is fixed via the protective elements 25, 26 both at the front and at the rear to a handrail support 12 on the treadmill 10.

The walking aid is moved by two drive wheels 16 spaced apart from the front deflection roller 3; these drive wheels 16 rest directly on the treadmill 10 and are formed with a rubber coating. In this respect, the drive wheels 16 are also arranged on the inside of the protective elements 25, 26. The moving surface 5 of the treadmill 10 causes rotation of the drive wheel 16. The movement of each drive wheel 16 is transmitted via a chain wheel 27 to a chain wheel 28 coupled to the front deflection rollers 3. The chain wheel 28 corresponds to the drive wheel assigned to the deflection roller 3. The transmission between each chain wheel 27 assigned to the drive wheel 16 and the chain wheel 28 assigned to the deflection roller 3 is carried out via a chain 29.

Here, both the chain wheels 27, 28 assigned to the drive wheels 16 and to the deflection rollers 3 are arranged on the outside of the protective elements. The drive wheels 16 and the chain wheels 27 have a common axle. This axle extends outwardly from both sides of the protective elements 25, 26 and, at the same time, forms the holding device of the walking aid on a treadmill frame.

With the illustrated walking aid, the patient is positioned between the two deflection rollers 3. The leg brace supports are fixed to the catches 18 pointed towards the patient.

Figure 8:
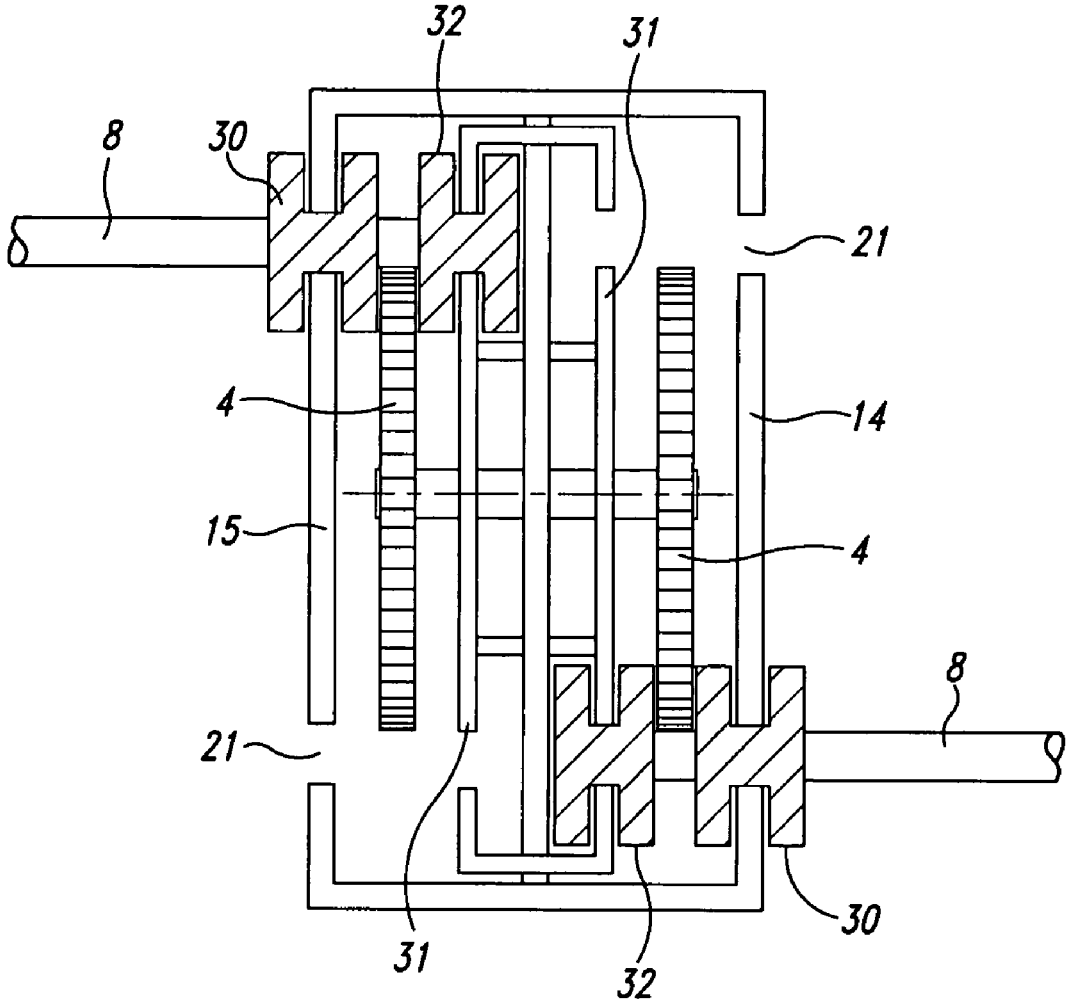
FIG. 8 is a cross-sectional view of the walking aid, according to another embodiment.

Another embodiment of the walking aid is shown in FIG. 8. The walking aid comprises two tractive elements 4, arranged parallel to each other. The tractive elements 4 are disposed inside a housing. Leg brace catches extend from respective tractive elements 4 to the outside through a slot-shaped opening 21 formed inside the relevant outer plate 14, 15. With this embodiment, the walking aid can be positioned between the patient's legs.

FIG. 8 shows a sectional view of the walking aid. The leg brace catch 18 can be further stabilized by a guide element 30 inside the slot-shaped opening 21. Each guide element 30 extends through the slot-shaped opening 21 and is formed on the outside and inside of each plate 14, 15 as a flat element, which extends parallel to the plate 14, 15 and is formed larger than the slot-shaped opening. The guide elements 30 can help guide the movement of the leg brace catch 18, so that any pressure exerted on the leg brace catch can be better absorbed. A guiding member in the housing is between the two tractive elements 4. The guiding member comprises a plate and a slot-shaped opening 31. Through this inner slot-shaped opening 31 extends an inner guide element 32, which extends as an extension of each leg brace catch 18 beyond the tractive element 4 inwards into the housing. This produces additional stabilization of the leg brace catches.

A similar stabilization is also possible with the embodiment shown in FIGS. 3 to 5. Here, corresponding guide elements 31, 32 can extend through the slot-shaped openings 21 of both plates 14, 15. With this embodiment, both the leg brace catch 18 and guide 31 and guide 32 of the opposite leg brace catch consequently run in each slot.

With all the walking aids described above, it is possible to design the holding devices of the leg braces in such a way that the patient wears a specially formed shoe with a snap closure mechanism that can be suspended in the leg brace support. This allows the patient to start the treadmill therapy independently without the aid of a therapist.

The invention claimed is:

1. A walking aid comprising:

two deflection rollers adapted to be driven by a motorized treadmill;

a tractive element guided over the two deflection rollers and coupled to a belt of the motorized treadmill when the walking aid is in a position for operation, the tractive element being caused to rotate around the two deflection rollers with motor-driven motion of the belt of the treadmill; and at least one fixing element attached to the tractive element to receive a holding device for a user's foot or leg, the fixing element moving with the tractive element to simulate a walking motion when the tractive element is driven by the belt of the motorized treadmill, the simulated walking motion defined by the tractive element during operation of the walking aid being non-circular.

2. The walking aid according to claim 1, further comprising:

two additional deflection rollers and an additional tractive element.

3. The walking aid according to claim 1 wherein the at least one fixing element comprises two fixing elements at diametrically opposite positions on the tractive element.

4. The walking aid according to claim 1, further comprising:

a lower leg holding device coupled to the at least one fixing element, the lower leg holding device swivelable about an axle parallel to a deflection roller axle.

5. The walking aid according to claim 1, further comprising:

two additional deflection rollers; and an additional tractive element, the additional tractive element guided over the two additional deflection rollers, and wherein the tractive elements are substantially parallel to each other.

6. The walking aid according to claim 5, wherein a fixing element is attached to each of the tractive elements, and wherein each of the fixing elements extends in a space between the tractive elements.

7. The walking aid according to claim 1 wherein the tractive element is a chain and the deflection rollers are chain wheels.

8. The walking aid according to claim 1 wherein the tractive element is a toothed belt.

9. The walking aid according to claim 8, wherein the toothed belt rests directly on a upper surface of the belt of the treadmill when the walking aid is in the position for operation so as to transmit movement of the upper surface of the belt of the treadmill to the deflection rollers when the belt of the treadmill moves.

10. The walking aid according to claim 9, wherein an outer surface of the toothed belt is provided with an applied material configured to increase frictional interaction with the upper surface of the belt of the treadmill.

11. The walking aid according to claim 1, further comprising:

a drive wheel in frictional contact with the belt of the treadmill and coupled to at least one of the deflection rollers.

12. The walking aid according to claim 11, wherein the drive wheel is substantially concentric with respect to the at least one of the deflection rollers, and wherein the drive wheel has a diameter that is substantially equal to a diameter of the at least one of the deflection rollers.

13. The walking aid according to claim 1, further comprising:

a first drive wheel in frictional contact with an upper surface of the belt of the treadmill when the walking aid is in the position for operation; and a second drive wheel positioned at a distance from the first drive wheel and coupled to one of the deflection rollers such that a movement of the upper surface of the belt of the treadmill is transmitted from the first drive wheel to the second drive wheel when the belt moves.

14. The walking aid according to claim 13, wherein the first drive wheel is disposed behind at least one of the deflection rollers.

15. The walking aid according to claim 13, wherein the first drive wheel is at a right angle to at least one of the deflection rollers.

16. The walking aid according to claim 13, wherein the first drive wheel is at a rear end of the walking aid.

17. The walking aid according to claim 13, wherein the first drive wheel is at a front end of the walking aid.

18. The walking aid according to claim 13, wherein the first drive wheel is located in front of the one of the deflection rollers.

19. The walking aid according to claim 13, further comprising:

an additional wheel between the first and second drive wheels, and wherein the first and second drive wheels are frictional wheels.

20. The walking aid according to claim 13, further comprising:

an additional tractive element, and wherein the first and second drive wheels are connected to each other via the additional tractive element.

21. The walking aid according to claim 1, further comprising:

a guide independently operable of the tractive element to guide the holding device.

22. The walking aid according to claim 1 wherein the at least one fixing element is a catch that is rotationally and translationally fixed to the tractive element.

23. The walking aid according to claim 22, wherein the catch is located on a side of the tractive element facing away from the two deflection rollers and extends a predetermined distance from the tractive element, and wherein the catch extends in a longitudinal direction along a receiver slot to receive a leg brace support so that the leg brace support is movable along the receiver slot.

24. The walking aid according to claim 1, further comprising:

a housing, the housing including a guide element located at a predetermined distance from the deflection rollers, and wherein the at least one fixing element extends through and out of the housing.

25. The walking aid according to claim 24, wherein the guide element is a slot-shaped opening.

26. The walking aid according to claim 25, wherein at least a section of the slot-shaped opening facing the treadmill is substantially parallel to the treadmill and the slot-shaped opening extends around each of the deflection rollers at a predetermined distance from the deflection rollers.

27. The walking aid according to claim 25, wherein sections of the slot-shaped opening around the deflection rollers have an arcuate shape.

28. The walking aid according to claim 24, wherein the housing includes two parallel plates.

29. The walking aid according to claim 28, wherein the deflection rollers are arranged between and coupled to the two parallel plates.

30. The walking aid according to claim 24, further comprising:

a running wheel coupled to the housing at a predetermined distance from one of the deflection rollers, the running wheel contacting the belt of the treadmill when the walking aid is in the position for operation.

31. The walking aid according to claim 1, further comprising:

a leg brace receiver, the holding device for the user's foot or leg swivelable at the leg brace receiver.

32. The walking aid according to claim 5, further comprising:

a first protective element positioned on an outer side of a first one of the tractive elements; and a second protective element positioned on an outer side of a second one of the tractive elements.

33. The walking aid according to claim 32, further comprising:

a drive wheel; and a drive train connected to the drive wheel and a first one of the deflection rollers, the drive train positioned on one side of the first one of the protective elements and the deflection roller positioned on the other side of the first one of the protective elements.

34. The walking aid according to claim 1 wherein the walking aid is configured to be fixed to a frame of the treadmill.

35. The walking aid according to claim 1 wherein the two deflection rollers are connected to each other via a longitudinal beam, and wherein the longitudinal beam couples the two deflection rollers to the treadmill.

36. The walking aid according to claim 35, further comprising:

a sliding sleeve in proximity to the longitudinal beam, the sliding sleeve being configured to allow the walking aid to move in relation to a handle of the treadmill.

37. The walking aid according to claim 36, wherein the walking aid is sized and configured to be coupled to a handrail frame of the treadmill.

38. The walking aid according to claim 24, wherein the housing extends to a cross beam arranged between a handrail frame of the treadmill, and the housing is movable around the cross beam.

39. The walking aid according to claim 38, wherein the housing has a through hole to receive the cross beam.

40. The walking aid according to claim 32, wherein the walking aid is connected via the protective elements to respective side areas of the treadmill.

41. The walking aid according to claim 1, further comprising:

an axle that fixes a front end of the walking aid to the treadmill; and drive wheels that rotate about the axle and are in frictional contact with the belt of the treadmill when the walking aid is in the position for operation.

42. The walking aid according to claim 41, further comprising:

an additional tractive element arranged parallel to the other tractive element, and wherein the axle extends through the drive wheels, each drive wheel corresponding to a respective one of the tractive elements.

43. The walking aid according to claim 1, further comprising:

a housing having a slot-shaped opening formed in an outer plate thereof to receive the at least one fixing element; and a guide element coupled to the slot-shaped opening and the at least one fixing element such that the at least one fixing element is held in the slot-shaped opening by the guide element.

44. The walking aid according to claim 43, wherein the guide element extends through the slot-shaped opening and comprises flat elements that are parallel to an inside wall and an outside wall of the outer plate of the housing.

45. The walking aid according to claim 43, further comprising:

another guide element coupled to the at least one fixing element, and wherein each guide element extends through one of two parallel walls of the housing.

46. The walking aid according to claim 43, further comprising:

an inner guide having a slot-shaped opening, the inner guide positioned on a side of the tractive element opposite the outer plate of the housing.

47. The walking aid according to claim 46, further comprising:

an additional inner guide that is formed parallel to the other inner guide.

48. The walking aid according to claim 1, further comprising:

a leg brace including an automatically locking closure.

49. A walking aid comprising:

a drive system adapted to be driven by a belt of a motorized treadmill, the drive system including two deflection rollers and a tractive element guided over the two deflection rollers, the tractive element coupled to the belt of the motorized treadmill during operation to rotate around the two deflection rollers with motor-driven motion of the belt; and at least one fixing element extending from the tractive element to receive a holding device for a foot or leg, the fixing element adapted to move with the tractive element to simulate a walking motion when the tractive element is driven by the belt of the motorized treadmill.

* * * * *

UNITED STATES PATENT AND TRADEMARK OFFICE

CERTIFICATE OF CORRECTION

PATENT NO. : 8,382,646 B2
APPLICATION NO. : 11/886891
DATED : February 26, 2013
INVENTOR(S) : Schoenenberger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 881 days.

Signed and Sealed this
Seventeenth Day of September, 2013

Teresa Stanek Rea
*Deputy Director of the United States Patent and Trademark Office*